US006615845B2

(12) United States Patent
Abraskin et al.

(10) Patent No.: US 6,615,845 B2
(45) Date of Patent: Sep. 9, 2003

(54) RHINESTONE DECORATING METHOD AND KIT

(76) Inventors: Gloria Abraskin, 4 Sudbury Rd., Morganville, NJ (US) 07751; Alan Abraskin, 4 Sudbury Rd., Morganville, NJ (US) 07751

( * ) Notice: Subject to any disclaimer, the term of this patent is extended or adjusted under 35 U.S.C. 154(b) by 0 days.

(21) Appl. No.: 10/043,821

(22) Filed: Jan. 14, 2002

(65) Prior Publication Data

US 2003/0131862 A1 Jul. 17, 2003

(51) Int. Cl.[7] ..... A45D 24/00
(52) U.S. Cl. ..... 132/200
(58) Field of Search ..... 132/200, 73, 73.5, 132/75.3, 76.2; 294/1.2, 1.1, 137

(56) References Cited

U.S. PATENT DOCUMENTS 3,584,908 A * 6/1971 Ray ..... 294/1.2
4,953,902 A * 9/1990 Brown ..... 294/1.1
5,232,752 A * 8/1993 Crespi et al. ..... 428/15
6,220,250 B1 * 4/2001 Park ..... 132/73

OTHER PUBLICATIONS

Physics by Erich Hausmann et al., Chapter XX, p. 329.

* cited by examiner

*Primary Examiner*—John J. Wilson
*Assistant Examiner*—Robyn Kien Doan
(74) *Attorney, Agent, or Firm*—Myron Amer, P.C.

(57) ABSTRACT

Applying a rhinestone facial display, and display at other locations on the person and on clothing using a transfer rod which transports the rhinestone held by a static electricity charge to an adhesive previously deposited at the display site and which rod is then backed off, which results in the rhinestone remaining because the adhesive attachment is greater than the hold of the static electricity charge.

2 Claims, 1 Drawing Sheet

RHINESTONE DECORATING METHOD AND KIT

The present invention relates generally to improvements for a rhinestone kit for decorating, preferably fingernails, but also other selected sites on the person or on clothing, in which more particularly, the improvements facilitate the positioning and/or placement of the rhinestone(s) on the selected display site. The diminutive size and lightweight of a rhinestone gives rise to handling difficulties in transporting the rhinestone from a supply to a display site, as well as other drawbacks which the improvements address and effectively obviate, all as will be better understood as the description proceeds.

EXAMPLE OF THE PRIOR ART

Likening a rhinestone to a fragile article such as a soft contact lens, it is instructive to study what is disclosed and illustrated in U.S. Pat. No. 5,785,370 for "Soft Contact Lens Manipulating Device" issued to Pomerantz on Jul. 28, 1998. The '370 patent as well as all other known patents use a suction cup-type element made operative by a squeeze bulb to create a light vacuum to pick up and transport the soft contact lens to its site of use upon the cornea of a user's eye. The diminutive size of a rhinestone disqualifies the use of a suction cup pick up and, even allowing for a significant scaling down of the suction cup to the size of the rhinestone, the rhinestone is, as is known by common experience, a display object that achieves its display value because of a faceted surface, and this type of surface will not properly respond to an applied vacuum. Also, to release the transported rhinestone at the display site necessitates, if a suction cup is used, a release of the vacuum, a requirement which is difficult to achieve with a rhinestone.

Broadly, it is an object of the present invention to decorate as part of a fashion trend difficult to handle rhinestones overcoming the foregoing and other shortcomings of the prior art.

More particularly, it is an object to transport a rhinestone preparatory to its placement at a selected display site and, to use to advantage, the prior preparation of the display site to cause release of the transported rhinestone and completion of the rhinestone display.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
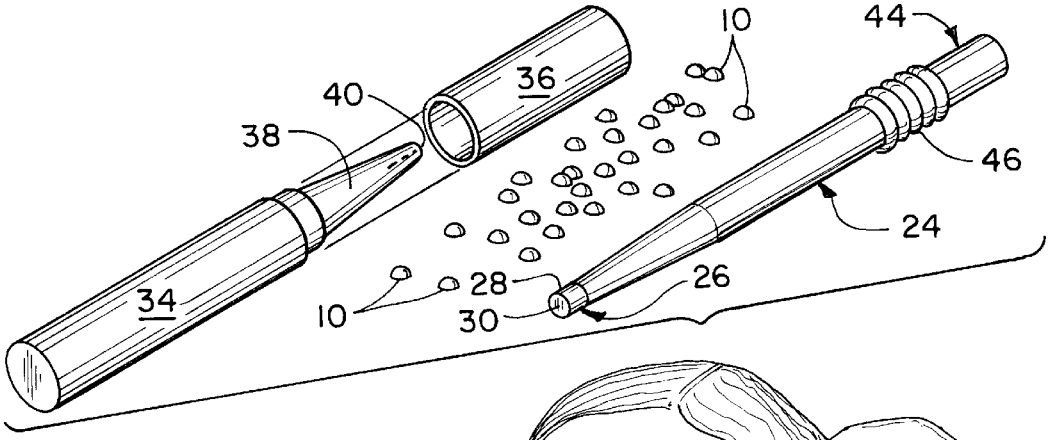
FIG. 1 is a perspective view of the components used in a method of decorating a fingernail with a rhinestone according to the present invention.
Figure 2:
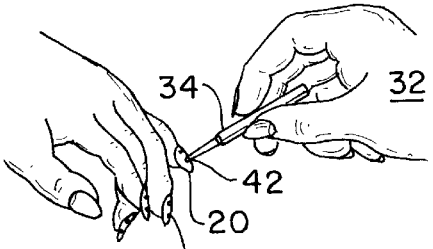
FIG. 2 is a perspective view of a method step of initial preparation of a rhinestone for display.
Figure 4:
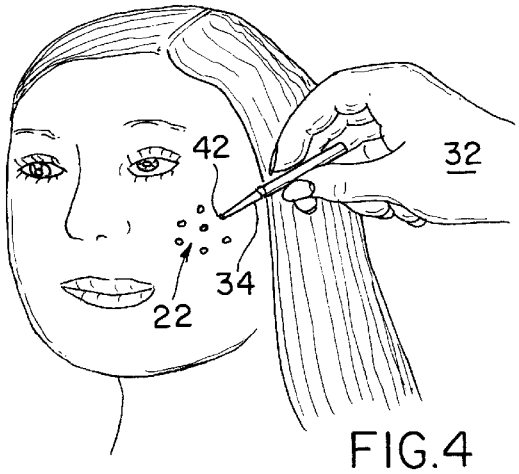
FIGS. 4 and 5 are also perspective views, but illustrating sequential method steps of a facial rhinestone display.
Figure 3:
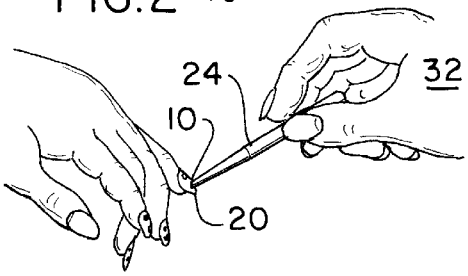
FIG. 3 is similarly a perspective view but of a subsequent method step illustrating completion of the rhinestone display on a fingernail.
Figure 5:
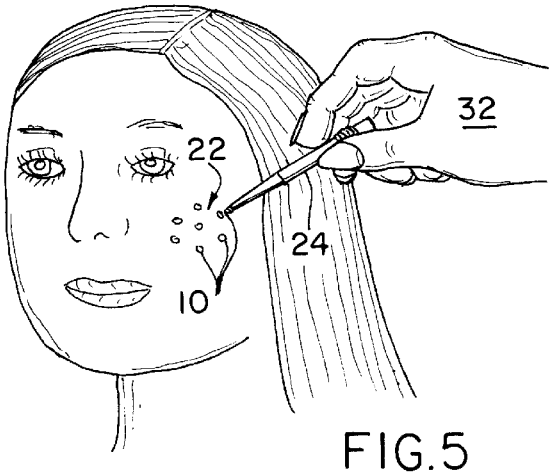
Figures 6, 7:
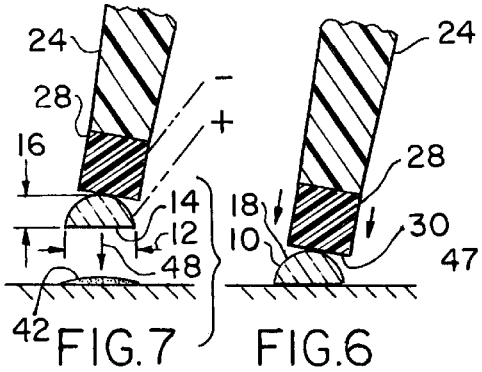
FIGS. 6 and 7 are cross-sectional views, hatched to denoted the construction material of the components, illustrating the method steps of pickup (FIG. 6) and deposit (FIG. 7) of a rhinestone according to the present invention.

Shown in FIG. 1 are rhinestones individually and collectively designated 10, each of glass construction material, as denoted by the hatching of the cross-sectional views of FIGS. 6 and 7, which each average slightly less than $1/16^{th}$ inch in diameter 12 of a circular flat bottom surface 14 and in height or altitude 16 of a semispherical shaped outer surface 18 used in decorating preferably a fingernail 20 but also on other display sites, as denoted at 22 in FIGS. 4 and 5 and, because of the diminutive size of each rhinestone 10 gives rise to handling difficulties in transporting the rhinestone from a supply to a site of display 20, 22. Addressing and providing an effective solution to this difficulty is the advantageous use, according to the present invention, of a transfer rod 24 having at its distal end 26 an outwardly cylindrical configuration 28 of elastomeric construction material having a construction material static electricity negative charge, denoted by a "minus" sign, and having a rhinestone-transporting surface 30, and cooperating therewith the previously noted selected rhinestone 10 as the decorating object and which is of glass and thus has a construction material static electricity positive charge, denoted by a "plus" sign, each rhinestone 10 for best results to maintain a static electric attachment having a weight which will be understood not to exceed approximately 0.05 grams, and which has been found in practice not to release from a static electric attachment during transport due to the weight of the rhinestone.

The user 32 is provided with a vial 34 of any one of a wide range of adhesives, such as an adhesive commercially available from East Coast Labs of Greensboro, N.C., and instructed to remove the vial cover 36 and to cut off a tip of an applicator configuration 38 to create an exit opening 40. Using the thusly prepared vial 34, the user then makes a deposit 42 of the adhesive at the selected display site, as best noted in the enlarged scale illustration of FIG. 7, in preparation for the transport of a rhinestone 10 to the adhesive deposit 42.

The transport of the rhinestone 10 is facilitated using the transfer rod 24, the user being instructed to grip the rod proximal end 44 using the knurl grip 46, and establish an interengagement, as best understood from FIG. 6, between the rhinestone 10 on a support surface 47 at the interface of the outer semispherical rhinestone surface 18 the transfer rod rhinestone-transporting surface 30 which, it will be noted, leaves exposed for subsequent utility the flat bottom surface 14 of the rhinestone.

More particularly, after the static electricity attachment of FIG. 6, the rhinestone 10 transported on the transfer rod 24 is urged in directional movement 48 which establishes adhesive contact between the adhesive deposit 42 on the fingernail 20, or on the cheekbone of the user 32 as illustrated in FIGS. 4 and 5 if such is the selected display site, and upon reverse directional movement of the transfer rod 24 it will be readily understood that the rhinestone 10 releases from its electrostatic attachment to the transfer rod surface 30 and remains on the fingernail 20 or other display site because the extent of the firmness of the adhesive attachment exceeds that of electrostatic attachment, the adhesive deposit 42 then curing to complete an attachment to an extent obviating inadvertent disengagement due to normal activity.

In addition to display sites on the person, it is also contemplated decorating sites on clothing, particularly headbands and sneakers, using the method described and illustrated.

While the components for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of decorating a fingernail with a rhinestone comprising the steps of:

A. making an adhesive deposit on a fingernail;

B. using an elongated transfer rod;

C. attaching on a distal end of said transfer rod an outwardly facing cylindrical configuration of elastomeric construction material having a construction material static electricity negative charge and having a rhinestone-transporting surface;

D. selecting for fingernail decoration a rhinestone of glass construction material having a construction material static electricity positive charge, a weight not exceeding approximately 0.05 grams, an outer semi-spherical surface and flat bottom surface;

E. establishing an interengagement by contact between said outer semi-spherical rhinestone surface and said transfer rod rhinestone-transporting surface and leaving exposed said flat bottom surface thereof; and F. establishing adhesive contact between said adhesive deposit on said fingernail and said exposed said flat bottom surface of said rhinestone using direction movement of said transfer rod;

whereby upon reverse directional movement of said transfer rod said rhinestone releases from said interengagement to said transfer rod and remains on said fingernail for completing an adhesive attachment thereto.

2. A method of decorating a selected site for display with a rhinestone comprising the steps of:

A. making an adhesive deposit on said display site;

B. using an elongated transfer rod;

C. attaching on a distal end of said transfer rod an outwardly facing cylindrical configuration of elastomeric construction material having a construction material static electricity negative charge and having a rhinestone-transporting surface;

D. selecting for said display site decoration a rhinestone of glass construction material having a construction material static electricity positive charge, a weight not exceeding approximately 0.05 grams, an outer semi-spherical surface and flat bottom surface;

E. establishing an interengagement by contact between said outer semi-spherical rhinestone surface and said transfer rod rhinestone-transporting surface and leaving exposed said flat bottom surface thereof; and F. establishing adhesive contact between said adhesive deposit on said display site and said exposed said flat bottom surface of said rhinestone using direction movement of said transfer rod;

whereby upon reverse directional movement of said transfer rod said rhinestone releases from said interengagement to said transfer rod and remains on said display site for completing an adhesive attachment thereto.

* * * * *